US010986907B2

(12) United States Patent
Bransfield et al.

(10) Patent No.: US 10,986,907 B2
(45) **Date of Patent: *Apr. 27, 2021**

(54) SECUREMENT APPARATUS FOR A PORTABLE ELECTRONIC DEVICE

(71) Applicant: Daca Design LLC, Garden City, NY (US)

(72) Inventors: Nina Bransfield, Garden City, NY (US); Brannen Brock, Port Washington, NY (US)

(73) Assignee: DACA DESIGN LLC, Garden City, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,474

(22) Filed: May 25, 2018

(65) Prior Publication Data

US 2018/0271243 A1 Sep. 27, 2018

Related U.S. Application Data

(63) Continuation of application No. 14/747,742, filed on Jun. 23, 2015, now Pat. No. 9,980,542, which is a continuation of application No. 13/839,179, filed on Mar. 15, 2013, now Pat. No. 9,060,588.

(51) Int. Cl.

| | |
|---|---|
| ***A45F 5/00*** | (2006.01) |
| ***A45C 11/00*** | (2006.01) |
| ***A45F 5/02*** | (2006.01) |

(52) U.S. Cl.

CPC ..... *A45C 11/00* (2013.01); *A45F 5/00* (2013.01); *A45F 5/02* (2013.01); *A45C 2011/002* (2013.01); *A45F 2005/006* (2013.01); *A45F 2005/023* (2013.01); *A45F 2200/0516* (2013.01); *Y10T 24/1397* (2015.01); *Y10T 29/49947* (2015.01)

(58) Field of Classification Search

CPC ..... A45F 2200/0516; A45F 2200/008; A45F 2200/0525; A45F 5/02; A45F 5/00; F16M 13/04

See application file for complete search history.

(56) References Cited

U.S. PATENT DOCUMENTS

| | | | |
|---|---|---|---|
| 4,771,927 | A | 9/1988 | Ventura |
| 4,785,984 | A | 11/1988 | Seitz-Gangemi |
| 5,535,928 | A | 7/1996 | Herring |
| 5,653,336 | A | 8/1997 | Buonaiuto et al. |

(Continued)

FOREIGN PATENT DOCUMENTS

| | | | |
|---|---|---|---|
| CA | 2620603 | A1 | 8/2008 |
| CA | 2671639 | A1 | 1/2010 |

(Continued)

*Primary Examiner* — Adam J Waggenspack

(74) *Attorney, Agent, or Firm* — Hoffmann and Baron, LLP

(57) ABSTRACT

A securement apparatus for a portable electronic device including a body having a panel and a plurality of elastomeric retainers secured to and extending from the panel. Each retainer forming a loop defining an opening, the openings adapted to receive therein a corner of a handheld electronic device. A tether is connected to and extending from the body. A strap is secured to the tether. An attachment device is operably connected to the strap to secure the apparatus to a member.

14 Claims, 7 Drawing Sheets

(56) References Cited

U.S. PATENT DOCUMENTS

| | | | | |
|---|---|---|---|---|
| 6,182,878 | B1 | 2/2001 | Racca | |
| 6,345,751 | B1 | 2/2002 | Elliot | |
| D467,069 | S | 12/2002 | TenHoeve | |
| 6,568,576 | B1 | 5/2003 | Godshaw et al. | |
| D482,671 | S | 11/2003 | DiDonato | |
| 6,662,986 | B2 | 12/2003 | Lehtonen | |
| D518,950 | S | 4/2006 | Condiff | |
| 7,120,247 | B1 | 10/2006 | Wade | |
| 7,270,255 | B2 | 9/2007 | Badillo et al. | |
| 7,431,251 | B2 | 10/2008 | Carnevali | |
| 7,584,710 | B2 * | 9/2009 | Grundy | A45F 5/02 112/153 |
| 7,938,260 | B2 | 5/2011 | Lin | |
| D656,479 | S | 3/2012 | Lin | |
| 8,220,767 | B2 | 7/2012 | Lin | |
| 8,256,568 | B2 | 9/2012 | Lin | |
| D669,462 | S | 10/2012 | Avrahami et al. | |
| 8,424,831 | B2 | 4/2013 | Lin | |
| D691,991 | S * | 10/2013 | Mohan | D14/250 |
| 8,561,862 | B2 | 10/2013 | Foggiato | |
| D693,580 | S | 11/2013 | Baker | |
| 8,714,422 | B2 | 5/2014 | Yu | |
| 9,060,588 | B2 * | 6/2015 | Bransfield | A45F 5/02 |
| 9,980,542 | B2 * | 5/2018 | Bransfield | A45F 5/02 |
| 2004/0069823 | A1 | 4/2004 | Condiff | |
| 2005/0284903 | A1 * | 12/2005 | Knapp | A45F 5/02 224/269 |
| 2006/0113345 | A1 * | 6/2006 | Zoullas | A45F 5/00 224/600 |
| 2011/0036876 | A1 | 2/2011 | Fathollahi | |
| 2011/0284599 | A1 | 11/2011 | Sternick | |
| 2012/0024917 | A1 * | 2/2012 | Case | A45F 3/02 224/259 |
| 2012/0063066 | A1 | 3/2012 | Floit | |
| 2012/0091307 | A1 | 4/2012 | Haynes | |
| 2012/0091312 | A1 * | 4/2012 | Baker | F16M 13/00 248/682 |
| 2012/0097831 | A1 * | 4/2012 | Olukotun | F16M 11/041 248/688 |
| 2012/0267402 | A1 | 10/2012 | Beatty | |
| 2012/0285859 | A1 | 11/2012 | Law et al. | |
| 2014/0192478 | A1 * | 7/2014 | Houvener | G06F 1/163 361/679.41 |

FOREIGN PATENT DOCUMENTS

| | | | |
|---|---|---|---|
| CN | 201104362 | Y | 8/2008 |
| CN | 201226923 | Y | 4/2009 |
| CN | 201957239 | U | 8/2011 |
| CN | 206511348 | U | 9/2017 |
| CN | 206852241 | U | 1/2018 |
| DE | 202019103074 | U1 | 6/2019 |
| EP | 1370051 | A1 | 12/2003 |
| GB | 2479903 | A | 11/2011 |
| MY | 142527 | A | 12/2010 |
| TW | M317785 | U | 9/2007 |
| TW | M328810 | U | 3/2008 |
| TW | M329359 | U | 4/2008 |
| TW | M330003 | U | 4/2008 |
| TW | M333024 | U | 5/2008 |
| TW | M344774 | U | 11/2008 |
| TW | M384563 | U1 | 7/2010 |
| TW | M384850 | U1 | 7/2010 |
| TW | M394026 | U1 | 12/2010 |
| TW | M394726 | U1 | 12/2010 |
| TW | M404462 | U1 | 5/2011 |
| TW | M404554 | U1 | 5/2011 |
| TW | M404555 | U1 | 5/2011 |
| TW | M405128 | U1 | 6/2011 |
| TW | M423983 | U1 | 3/2012 |
| TW | M440608 | U1 | 11/2012 |
| TW | M450868 | u1 | 4/2013 |
| TW | M452569 | U1 | 5/2013 |
| TW | M452589 | U1 | 5/2013 |
| TW | M483616 | U | 8/2014 |
| TW | M496380 | U | 3/2015 |
| TW | M540540 | U | 5/2017 |
| TW | M544231 | U | 7/2017 |
| TW | M576560 | U | 4/2019 |
| TW | M588404 | U | 12/2019 |

* cited by examiner

SECUREMENT APPARATUS FOR A PORTABLE ELECTRONIC DEVICE

CROSS-REFERENCE TO RELATED APPLICATIONS

This application is a continuation application of U.S. application Ser. No. 14/747,742, filed Jun. 23, 2015, which is a continuation of U.S. application Ser. No. 13/839,179, filed Mar. 15, 2013, issued as U.S. Pat. No. 9,060,588 on Jun. 23, 2015, the specification of each being incorporated herein by reference in their entirety for all purposes.

FIELD OF THE INVENTION

The present invention relates to a device for securing a portable electronic device. More particular, the present invention relates to an elastomeric apparatus securable to the device and the apparatus being securable to a user.

BACKGROUND

Portable electronic devices may include handheld mobile devices such as cell phones, smartphones, tablets, music/mp3 players, and cameras. Such devices are becoming ever more popular with users. Due to the portable nature of these devices, they can be placed in pockets of jackets, coats, pants or shirts in order to carry them around. This method of transportation, however, makes the devices susceptible to being unintentionally dropped or otherwise separated from the user or their gear. This is especially the case as the devices become larger in order to provide larger viewing screens, such as is the case with smartphones.

In certain situations, even if a device has a sturdy case, damage or loss may occur when it is dropped. The device may fall out of a user's pocket with the user being unaware, thereby leading to loss of the device. In addition, when a user engages in activities such as skiing or boating, if the electronic device were to become inadvertently separated from the user or their gear, the device could easily become lost for good.

Certain attachment devices are known in the prior art for securing mobile devices to users. These attachment devices typically include straps that require a dedicated opening in the device or the case in order to allow the strap to be attached. However, many of the current portable devices lack this feature, thereby making it difficult to attach a securement strap.

Accordingly, it would be desirable to provide an apparatus that allows a handheld mobile electronic device to be safely secured to a user, their gear, or other member to which they wish to secure the apparatus.

SUMMARY OF THE INVENTION

The present invention provides an apparatus for securing a handheld electronic device to a user, their gear, or other member to which they wish to secure the apparatus.

The present invention further provides a securement apparatus for a portable electronic device including a body having a panel and a plurality of elastomeric retainers secured to and extending from the panel. Each retainer forming a loop defining an opening, the openings adapted to receive therein a corner of a handheld electronic device. A tether is connected to and extending from the body. A strap is secured to the tether. An attachment device is operably connected to the strap to secure the apparatus to a user.

The present invention further provides a cell phone securement device including an elastomeric body having a plurality of openings formed therein. The body has a plurality of bands extending from a central panel. The bands at least partially surround the openings. Each of the openings is adapted to receive a corner of a cell phone. The panel has four corners and ends of the bands join at each corner. A tether is secured to and extends from the body, and a strap is secured to the tether. An attachment device is operably connected to the strap. The attachment device is adapted to secure the apparatus to a member.

The present invention further provides a method of securing a mobile electronic device to a member including, providing a securement apparatus including a body having a panel and a plurality of elastomeric retainers secured to and extending from the panel, each retainer forming a loop defining an opening, the openings adapted to receive therein a corner of a handheld electronic device; a tether connected to and extending from the body; a strap secured to the tether; an attachment device operably connected to the strap;

inserting a corner of the mobile device in one of the openings and stretching the band defining the opening over a surface of the mobile device;

stretching the remaining bands over the remaining corners of the mobile device wherein each corner of the model device enters one of the openings of the securement apparatus, thereby securing the securement apparatus to the mobile device; and attaching the attachment device to the member.

DETAILED DESCRIPTION OF THE PREFERRED EMBODIMENTS

Figure 1:
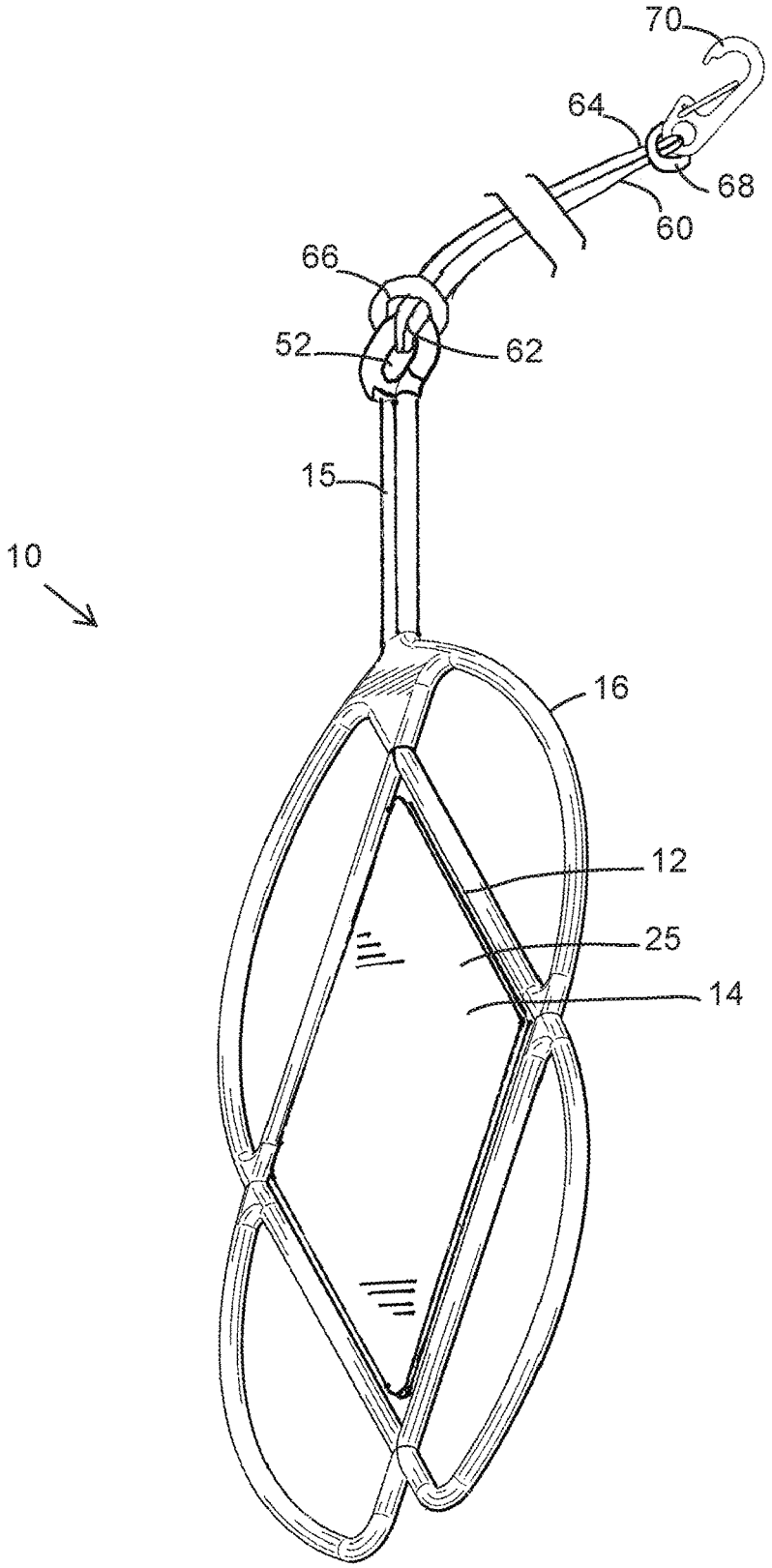
FIG. 1 is a front perspective view of the securement device of the present invention.

With reference to FIGS. 1-8, a securement apparatus 10 for securing a portable electronic device 11 to a member 13 is shown. The portable electronic device may be, for example, a cell phone, such as a smartphone, beeper, tablet, handheld GPS, music/mp3 player or camera. The member may include for example, a user, their clothing, bags or other gear, a structure of a vehicle or boat or other member. The securement apparatus 10, attaches to the portable electronic device 11, and the securement apparatus is then secured to a member in order to prevent its loss or damage. If the electronic device 11 were to fall out of one's, hand, pocket, or bag, it will remain attached to the user, for example, and not become lost or damaged.

The securement apparatus 10 includes a body 12 having a panel 14 and a plurality of elastomeric retainers 16 secured to, and extending from, the panel 14. The retainers 16 may be in the form of elastic bands having ends which are operatively secured to the panel 14. A tether 15 may extend outwardly from the body. In one embodiment, the body components and tether may be internally formed as one unitary piece. Alternatively, it is within the contemplation of the present invention that the different elements can be formed separately and then joined together as manners well known in the art. The material used to form the body and tether may include an elastomer having a high degree of elasticity and resistance to tearing such as silicon rubber. However, other elastomers or materials having elastomeric properties could be used.

The panel 14 may be generally centrically located and includes four corners to which the end of the bands are secured. In one embodiment, the panel 14 may take the shape of a diamond having two side corners 18 and 20 and a top 22 and bottom 24 corner. In this disclosure, the terms top and bottom are used to help describe relative position but are not intended to define a particular orientation. Additionally, it is within the contemplation of the present invention that the panel 14 could be formed in different shapes. The central panel 14 may be formed of a relatively flat piece of elastomeric material which allows it to stretch and return back to its original configuration. The panel edges 26 may be reinforced by a rim 28. A groove 23 may be formed between the panel surface front surface 25 and the rim 28. A panel back surface 27 (FIG. 5) may be uniformly smooth throughout its surface. The rim 28 may be secured to the ends of the bands 16 such that the bands are secured to the panel 14 at a reinforced portion.

The panel may be secured to a node 30. The node 30 is a reinforced portion of the body to which ends of two of the bands are connected to the panel top corner. The tether 15 is also secured to the node and extends outwardly in a direction opposed from that of the panel. The node 30 may have a generally triangular shape that tapers to a relatively narrow neck 32 to which the panel top corner 22 attaches. The node may have a thickness similar to the rim 28. The node 30 provides a strong securement location for the various elements and helps to resist their separation.

Figure 2:
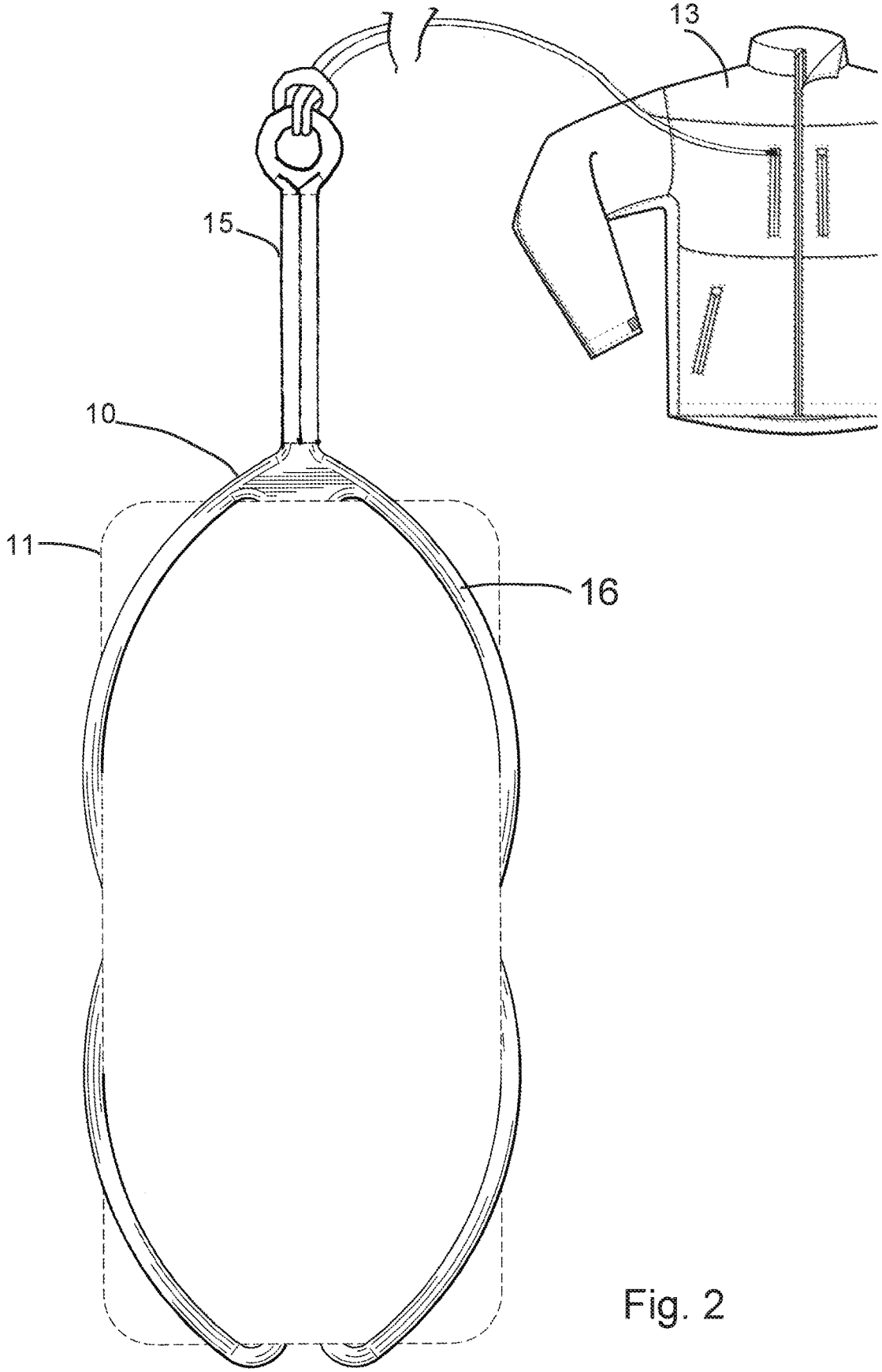
FIG. 2 is a top plan view of a mobile device with the securement device of FIG. 1 attached thereto.
Figure 3:
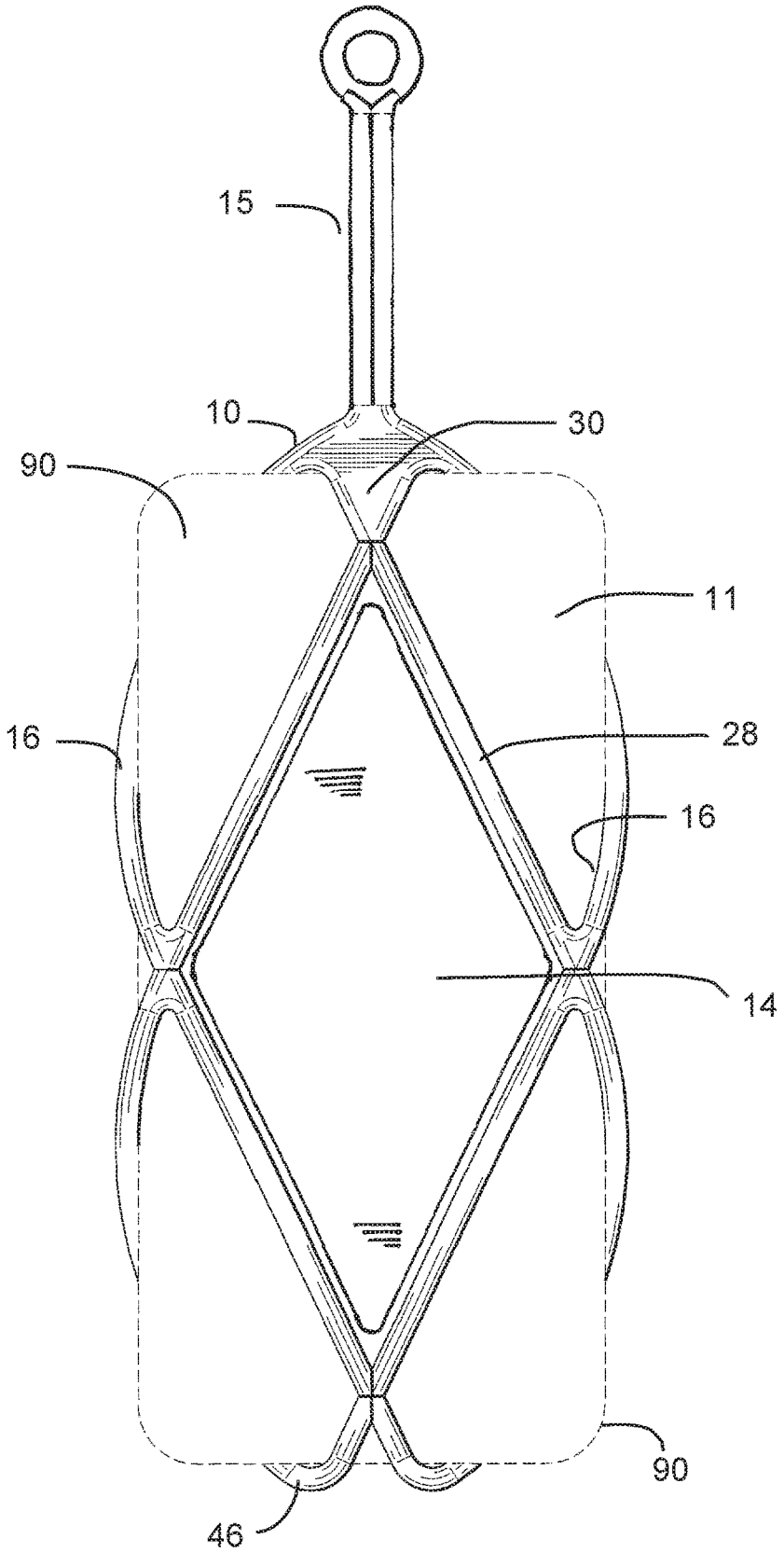
FIG. 3 is a back side view of a mobile device with the securement device attached thereto

The plurality of bands 16 are resilient members that are stretchable over a portion of an electronic device 11 as will be described below. The bands 16 may have a generally round cross-section with a diameter of approximately in the range of 0.05" to 0.25". It is further contemplated that the bands could be formed having other cross-sectional configuration such as rectangular or elliptical. The bands form four openings 17 adapted to receive and accommodate the corners of the electronic device. The plurality of bands 16 includes a first pair of bands 34. One of the first pair of bands 36 extends from a first side corner 18 up toward the node 30 which is attached to the top panel corner 22. A second band 38 of the first pair extends from the opposite side corner 20 upwardly towards the node 30. The first pair of bands 34 each have a generally arcuate configuration that bow outwardly from the panel when in the relaxed un-stretched position as shown in FIGS. 1-3.

A second pair of elastic bands 40 are also included. One of the second pair of bands 42 is corrected to the panel first side corner 18 and extends downwardly to the panel bottom corner 24. The second band 44 of the second pair extends downwardly from the panel second side corner 20 toward the bottom corner 24. Accordingly, the bottom ends 46 of the second pair of bands are secured to the panel at substantially the same location. The second pair of bands 40 have a generally arcuate shape that bows outwardly from the panel 14. The band bottom ends 46 each and have a portion that extends beyond the bottom corner 24 and curve upwardly to join therewith, creating a W-shaped structure.

Figure 4:
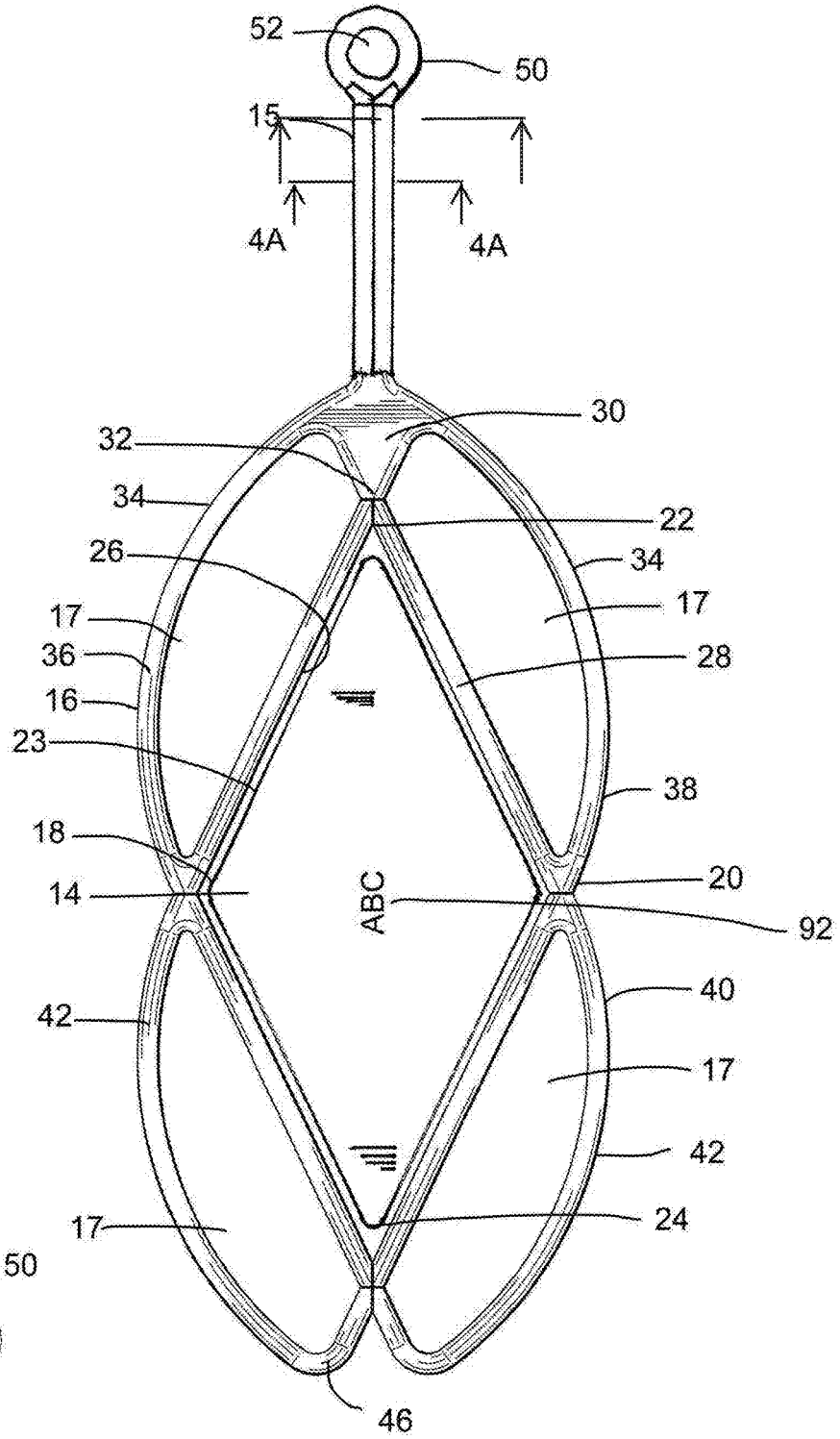
FIG. 4 is a top plan view of the securement device.
Figure 4A:
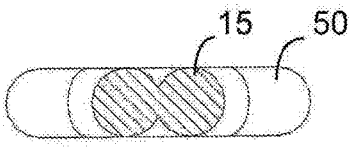
FIG. 4A is a cross-sectional view taken along line 4A-4A thereof.
Figure 5:
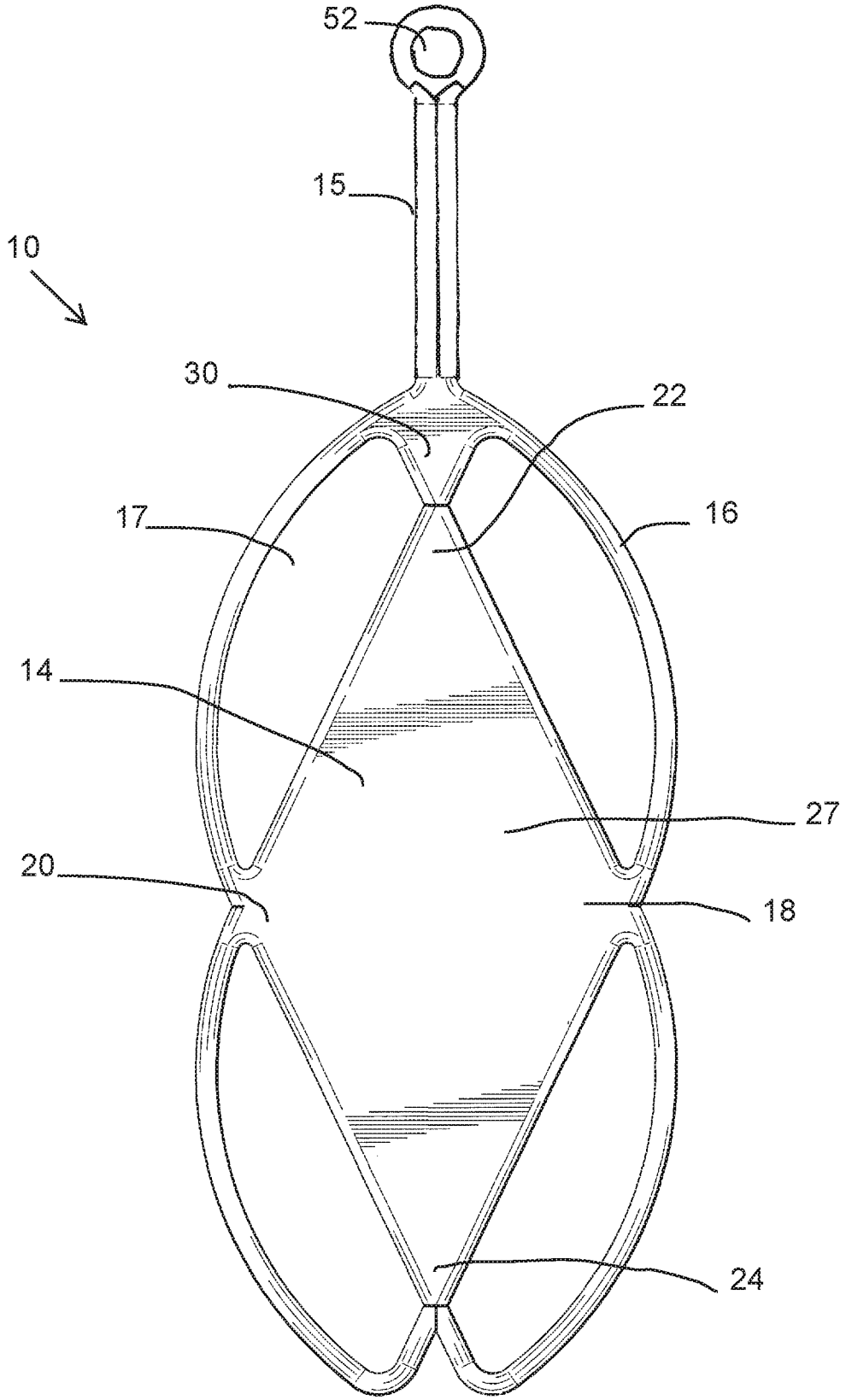
FIG. 5 bottom elevational view of the securement device.
Figure 6:
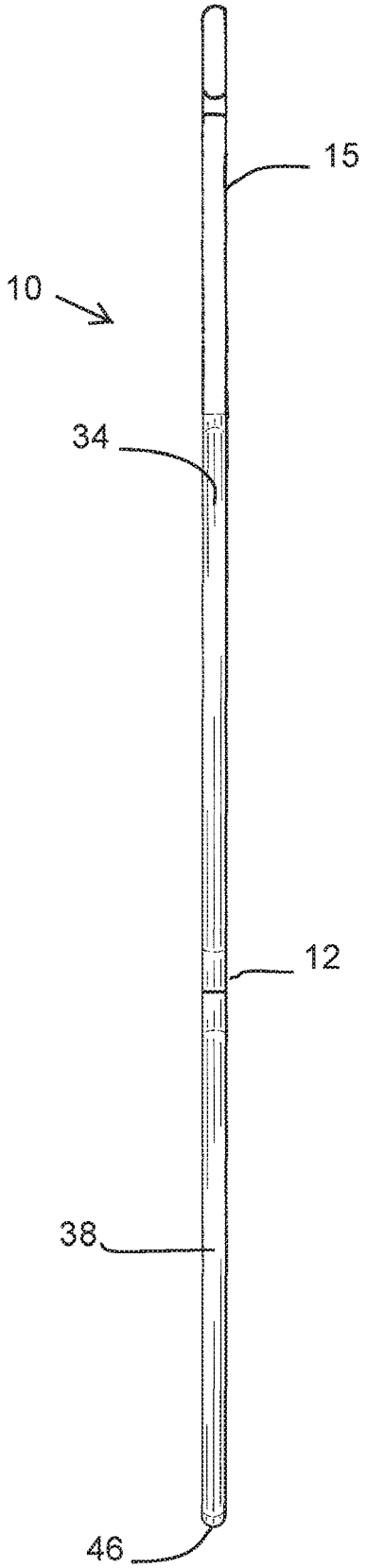
FIG. 6 side elevational view of the securement device.
Figure 7:
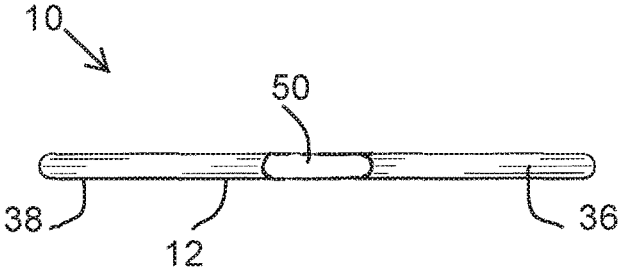
FIG. 7 is a top end view of the securement device.
Figure 8:
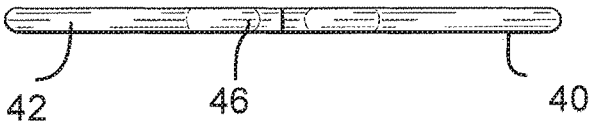
FIG. 8 is a bottom end view of the securement device.

The tether 15 attached to node 30 is an elongate member having a round distal end 50 including an aperture 52 formed therein. The tether is also formed of an elastomeric material and may be integrally formed with the body. In cross-section, as shown in FIG. 4A, the tether may include a longitudinally extending groove 54 formed along the top and bottom side.

Figure 9:
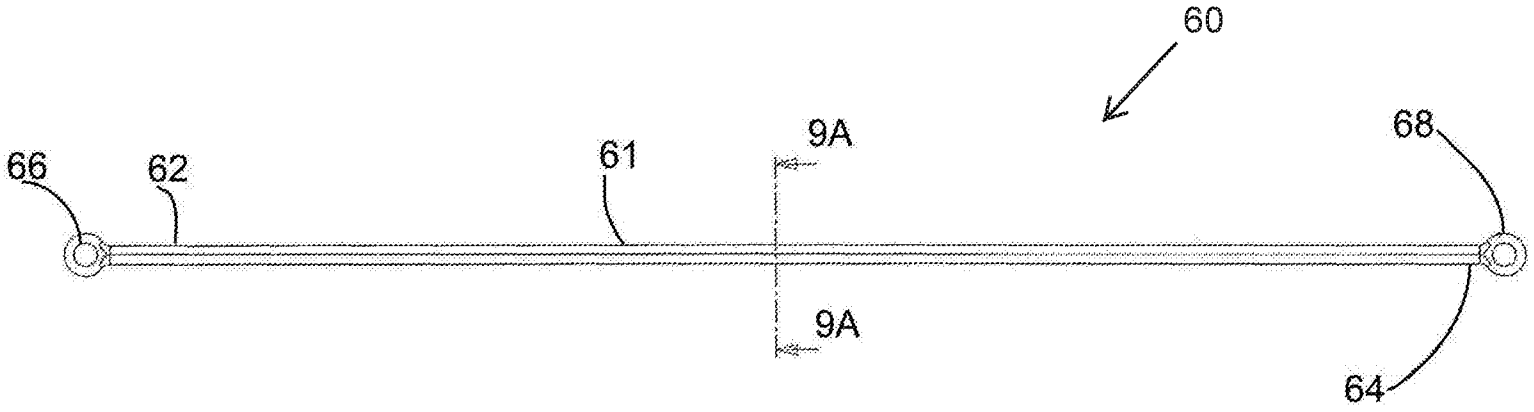
FIG. 9 is top plan view of a strap of the securement device.
Figure 9A:
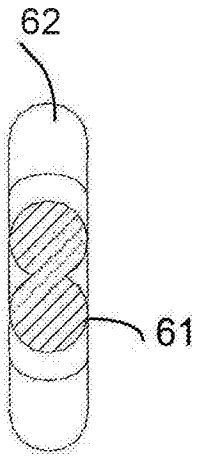
FIG. 9A is a cross-sectional view taken along line 9A-9A of FIG. 9.

With reference to FIGS. 1, 9, and 9A, a strap 60 may be secured to the tether distal end 50. The strap 60 may be formed of a variety of materials such as elastomer, (same or different from the material used for the body), wire, nylon, leather strapping, rope, cord, etc. The strap 60 may include an elongate body 61 having a round first and second end 62 and 64. In one embodiment, the strap 60 may have a ring opening disposed at each end. A first ring opening 66 formed on first end 62 may be extended through the tether aperture 52 allowing a portion of the strap to be pulled there though. The strap second end 64 may then extend through the first end ring opening 66 in order to allow the strap to be secured to the tether. In is within the contemplation of the present invention that alternative means of securing straps together such as those known in the art may be used.

The strap second end 64 may include an second ring 68 to which an attachment device 70 is operatively connected thereto. The attachment device 70 may be in the form of a clip, carabiner, clasp or other attachment device that may be removably attachable to a user (FIG. 1). For example, the attachment device may be secured to a member such as piece of the user's clothing, e.g., a coat, pants, belt, belt loop, etc. In an alternative embodiment, the strap may be in the form of a neck lanyard having a clasp of a type known in the art which is securable to the tether. With the attachment device 70 secured to the member 13, if the portable device 11 were to fall out of a user's hand, pocket, or gear, it would remain secured to the member 13, thereby preventing loss or damage.

With reference to FIGS. 1, 2, and 3, the securement apparatus 10 may be removably securable to a portable electronic device 11 such as a cell phone shown in dashed line. A portable device 11 may be placed into one of the four securement apparatus openings 17. Due to the elastic nature of the bands 16, they can be stretched over the corner 90 of the device. The remaining three bands may then be stretched over the other corners of the device such that all four corners of the device are secured, as shown in FIGS. 2 and 3. The bands 16 resiliently engage the portable device 11 and retain the securement apparatus to the device 11. In addition, the elastic nature of the panel 14 allow it to stretch to help the securement apparatus fit on the mobile device. The securement apparatus may be secured to the phone such that the flat back surface 27 of the panel lays adjacent the phone. Due to the elastic nature of the panel 14 and bands 16, the apparatus 10 may be stretched to accommodate and resiliently engage portable electronic devices of different sizes. Removal of the securement apparatus 10 from the mobile device 90 simply requires stretching the bands 16 away from the mobile device 90 and pulling the apparatus away from the device.

When the securement apparatus is placed on to the mobile device, a portion of the bands 16 extend over the front face of the cell phone as shown in FIG. 2. However, since the bands extend just over the device's corners, they do not hinder the viewing of images on the device's screen. In addition, the resilient nature of the bands 16 help provide a degree of protection to the display when the portable device 11 is placed on a surface with the display facing downwardly.

As shown in FIG. 3, when the securement apparatus is attached to the mobile device, the panel front surface 25 provides an area upon which graphics, images, or other indicia 92 may be placed thereon. The back surface 27 may also include indicia (not shown) that would be visible when the securement device is not attached to a mobile device.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A securement apparatus for a portable electronic device comprising:

a body having a perimeter defining therewithin an elastomeric panel;

a plurality of elastomeric bands extending from the panel, the plurality of bands defining at least three openings adapted to receive a corner of the portable electronic device;

the body having a node being secured to an upper portion of the panel, at least two of the plurality of bands being secured to the node and extending downwardly and connecting to the panel;

an attachment element coupled to the node;

a flexible cord having a first end secured to the attachment element and a second end connected to a clasp adapted to secure the cord to a user; and wherein two bands of the plurality of bands each have an end connected to a panel bottom portion, and the two bands together form a W-shaped element.

2. The securement apparatus of claim 1, wherein the node tapers as it extends from the panel to the attachment element.

3. The securement apparatus of claim 1, wherein the body is formed of one piece of elastomeric material.

4. A portable electronic device securement device comprising:

a flexible body including a plurality of bands extending therefrom, the bands defining a plurality of openings and each opening adapted to receive therethrough a corner of a portable electronic device;

the body including a perimeter rim defining therewithin a panel, the panel having a first surface bounded by the rim and a groove being disposed between the first surface and the rim;

a securement portion coupled to the body and having a aperture therein; and a cord secured to the securement portion.

5. A securement apparatus for a portable electronic device comprising:

a body having a panel including a top and a bottom, the panel including a solid, uninterrupted, elastomeric portion extending between the panel top and the panel bottom;

the body further including a plurality of elastomeric retainers secured to the panel, each retainer forming an opening adapted to receive a corner of the portable electronic device;

a node connected to the panel top, the plurality of retainers including a first and a second band each having a first and a second end, the first ends of the first and a second band being connected to the node, the first and second bands extending from the node downwardly to the panel and the second ends of the first and the second band being connected to the panel, and the plurality of retainers includes a third and a fourth band each including a first end connected together below the panel bottom, and wherein the panel includes at least two opposed corners, and the third and fourth bands each have a second end, the second end of the third band is connected to one corner of the at least two corners and the second end of the fourth band is connected to the other corner of the at least two corners;

an attachment element secured to and extending upwardly from the node and the attachment element including an aperture formed therein; and a neck lanyard secured to the attachment element.

6. The securement apparatus as defined in claim 5, wherein the body, the plurality of retainers, the node, and the attachment element are all formed as a single integral unitary device.

7. A securement apparatus for a portable electronic device comprising:

a body having an elastomeric panel including a solid and uninterrupted portion;

the body including at least three elastomeric retainers secured to and extending from the panel forming at least three openings adapted to receive a corner of the portable electronic device, each of the at least three retainers having an arcuate configuration forming a loop defining one of the at least three openings;

a node coupled to a panel top portion, and at least two retainers of the at least three retainers extending from the node downwardly to opposed sides of the panel, wherein the panel, the at least three retainers and the node are formed of a single unitary piece of elastomeric material and the at least three retainers, the at least three openings, and the panel lie in a same plane;

an elastomeric attachment element connected to and extending from the node, and extending upwardly beyond the at least two retainers; and a flexible cord including a proximal end coupled to the attachment element, the flexible cord including a distal end secured to an attachment device for removably securing the securement apparatus to a user.

8. A portable electronic device securement device comprising:

an elastomeric stretchable body defining a plurality of openings, the body having a plurality of bands extending from a panel, the plurality of bands at least partially surrounding the body openings and each of the plurality of openings is adapted to receive a corner of a portable electronic device;

the body having a perimeter rim defining therewithin the panel, the panel having a first surface bounded by a groove being disposed between the first surface and the rim, the first surface being solid and uninterrupted;

a node extending from the body; and a flexible lanyard forming a loop, the lanyard being secured to the node.

9. A securement apparatus for a portable electronic device comprising:

a body including an elastomeric panel;

a plurality of elastomeric bands coupled to the panel, the plurality of bands defining at least three openings wherein each opening is adapted to receive therein a corner of the portable electronic device;

the body having a node being coupled to an upper portion of the panel, at least two of the plurality of bands each having a first end and a second end, the first ends of the at least two of the plurality of bands being coupled to the node and the at least two of the plurality of bands extending outwardly from the node and downwardly toward the panel, the second ends of the at least two of the plurality of bands being connected to the panel, and the entire portion of the at least two of the plurality of bands between the first and second ends and the panel lie in a same plane;

an attachment element coupled to the node and extending above the at least two of the plurality of bands; and a flexible cord including a proximal end coupled to the attachment element, the cord including a distal end secured to an attachment device for removably securing the securement apparatus to a user.

10. The securement apparatus of claim 9, wherein the attachment device is selected from the group consisting of a clip, a carabiner, and a clasp.

11. The securement apparatus of claim 9, wherein the attachment element defines an aperture for facilitating coupling of the flexible cord to the attachment element.

12. The securement apparatus as defined in claim 7, wherein a portion of the panel extending downwardly from the node increases in width.

13. The securement apparatus as defined in claim 1, wherein the attachment element includes an aperture therethrough, and the first end of the cord extends through the aperture to secure the cord to the attachment element.

14. the securement apparatus as defined in claim 5, wherein the attachment element includes in aperture therethrough.

* * * * *